United States Patent [19]

Anderson

[11] Patent Number: 4,877,107

[45] Date of Patent: Oct. 31, 1989

[54] MOBILE SCAFFOLDING SYSTEM AND SCAFFOLD SUPPORT

[76] Inventor: Carl Anderson, c/o Alum-A-Pole Corporation 2589 Richmond Ter., Staten Island, N.Y. 10303

[21] Appl. No.: 215,256

[22] Filed: Jul. 5, 1988

[51] Int. Cl.[4] ..... E04G 1/20; E04G 1/24

[52] U.S. Cl. ..... 182/17; 182/63; 182/141

[58] Field of Search ..... 182/17, 15, 145, 146, 182/63, 141

[56] References Cited

U.S. PATENT DOCUMENTS

| | | | |
|---|---|---|---|
| 198,576 | 12/1877 | D'Amore | 182/17 |
| 316,375 | 4/1885 | Lieb | 182/17 |
| 3,156,317 | 11/1964 | Lundeen | 182/146 |
| 3,323,616 | 6/1967 | Best | 182/146 |
| 3,851,728 | 12/1974 | Williams | 182/146 |
| 4,171,033 | 10/1979 | Rust | 182/145 |
| 4,598,794 | 7/1986 | Anderson | 182/145 |
| 4,641,728 | 2/1987 | McCabe | 182/146 |

*Primary Examiner*—Reinaldo P. Machado
*Attorney, Agent, or Firm*—Helfgott & Karas

[57] ABSTRACT

A mobile scaffolding system having a substantial rectangular rolling base which supports pump jack poles on which rides up and down pump jacks across which a platform is supported. The poles are supported by extensible supports when moved to a desired location and when a user mounts the platform, the poles extend downward to lock onto the support surface stabilizing the base and preventing further movement of the base.

46 Claims, 5 Drawing Sheets

MOBILE SCAFFOLDING SYSTEM AND SCAFFOLD SUPPORT

BACKGROUND OF THE INVENTION

My invention relates to scaffolding systems, and more particularly to pump jack pole type scaffolding equipment.

In numerous residential, commercial and industrial applications, it is necessary to erect scaffolding either internally or externally to enable workers to stand at an elevation above a floor or the ground or other supporting surface. If the scaffolding is to be erected adjacent an interior or exterior wall, the scaffolding system may typically comprise a pair of pump jack poles which are spaced apart on the supporting surface and which may be secured to the wall by suitable braces. The pump jacks ride up and down the poles and have support arms which carry the scaffold staging. The workers stand on the staging and operate the pump jacks to raise and lower the staging.

However, if this pump jack pole type scaffolding is to be erected in a free standing manner, for example, in a central region of a room or in an open area or adjacent to a wall without bracing to the wall, the problems of providing a supporting structure for the pump jack poles having sufficient rigidity and stability to ensure the safety of workers on the scaffolding become very difficult to solve.

If it is desired to be able to move such free-standing scaffolding from one location to another within a work area, without dismantling the scaffolding, a mobile supporting structure may be used. However, this not only aggravates the difficulty in providing sufficient rigidity and stability to the pump jack poles, but also introduces further problems of safety. The wheels used to provide mobility may not be locked tightly enough to prevent movement or may accidentally be left unlocked. Workers have also purposefully left the wheels unlocked in order to be able to move the scaffold alongside a wall from one stationary location to another without dismounting from the scaffold, thereby causing accidents. In addition such mobile scaffold supports have not heretofore been able easily to maintain the pump jack poles in essentially vertical positions despite changes in the level and grade of the supporting surface in each new location.

SUMMARY OF THE INVENTION

Accordingly, a principal object of my invention is to provide a pump jack pole type scaffolding system having a movable support capable of properly and safely supporting the scaffolding in a free-standing manner in each location to which it is moved.

Another object of the invention is to provide a mobile pump jack pole type scaffold support having sufficient rigidity, stability and motion restraint in each stationary work location to ensure the safety of persons on the scaffold even without braces between the pump jack poles and an adjacent wall.

A further object is to provide a mobile scaffolding system which can not be moved from one stationary location to another as long as a worker remains on the scaffold.

A still further object is to provide a mobile pump jack pole type scaffold support having means for adjusting the poles to a desired essentially vertical position despite changes in the level or grade of a supporting surface or in the weight applied to the scaffold at each location to which it is moved.

Briefly, in accord with the present invention, a movable support for a pump jack pole type scaffold is provided in the form of a rectangular four-sided structure having wheels depending therefrom for enabling movement of the structure along a supporting surface. A pair of pole receiving metal sleeves respectively abut and are secured to the two inside corners of the structure adjacent one side thereof. These metal sleeves are constructed to slideably receive and support the bottom end portions of a pair of pump jack poles.

Means are also provided for stabilizing and restraining motion of the structure in each stationary location. Such stabilizing and motion restraining means are downwardly extensible from the structure beyond its wheels to press against the ultimate supporting surface. These restraining means can comprise a pole releasing means which permits the pole to descend to the ground when someone mounts the scaffold. The grounded pole secures the structure and prevents its rolling. Alternately the restraining means can comprise a pair of extensible boots respectively secured to the outside of the metal sleeves and covering the bottom openings thereof. The pump jack poles inserted within these boots thus rest upon and are carried in these boots while the supporting structure is moved from one location to another. However, these boots are extended beyond the wheels to reach the ultimate supporting surface by the force of the pump jack poles when these poles are sufficiently weighted down, such as by the weight of a person on the scaffold staging carried by the pump jacks. The pump jack poles are then directly supported at their bottom ends on the ultimate supporting surface and the entire structure cannot be moved as long as a person remains on the scaffold. When the legs of the structure are also screwed down against this ultimate supporting surface, this also restrains the structure against any motion and helps to stabilize the structure so that the poles are maintained in essentially vertical positions even though the scaffold carried by the poles is heavily weighted down.

By adjusting the thickness and composition of the boots that are used to cover the bottom openings of the sleeves, they may be constructed to carry the weight of the pump jack poles without extension as well as the weight of scaffolding placed on the pump jacks, and become extended to reach the ultimate supporting surface only when the weight of a person is added to that of the staging.

In accordance with further features of the invention, the four-sided structure is provided with at least two outrigger type wings respectively pivoted along the outside of the remaining two corners of the structure opposite the corners containing the pole receiving metal sleeves. Preferably, four such outrigger type wings are provided pivoted at the four corners of the structure with two of these four wings respectively folded alongside each other on one pair of opposite sides of the structure. These wings carry screw-down legs at their distal ends. When they are swung open on their pivots to various radial positions, for example, perpendicular to the remaining two sides of the structure, and their legs are screwed down against a supporting surface, the entire structure and the scaffolding supported thereby can be further stabilized and restrained against any motion.

These wings or the pole itself may also carry exposed level indicating devices so that the screw-down legs may be easily adjusted in height to level the entire structure or to otherwise maintain the poles in desired essentially vertical positions despite differences in the height or grade of the supporting surface or in the weight being applied to the scaffold.

For strength and maneuverability the four-sided support structure is constructed in the form of an interconnected framework of lightweight metal rods. Alternatively, it may be a box in which accessory equipment may be stored and carried.

The foregoing objects, features and advantages of the invention may be better understood by referring to the following detailed description taken in conjunction with the accompanying drawings.

BRIEF DESCRIPTION OF THE DRAWINGS

In the drawings:

FIG. 2 is a perspective view of the system of FIG. 1 and taken from the opposite side and illustrating a further embodiment of the invention, wherein

DETAILED DESCRIPTION OF THE INVENTION

Figure 1:
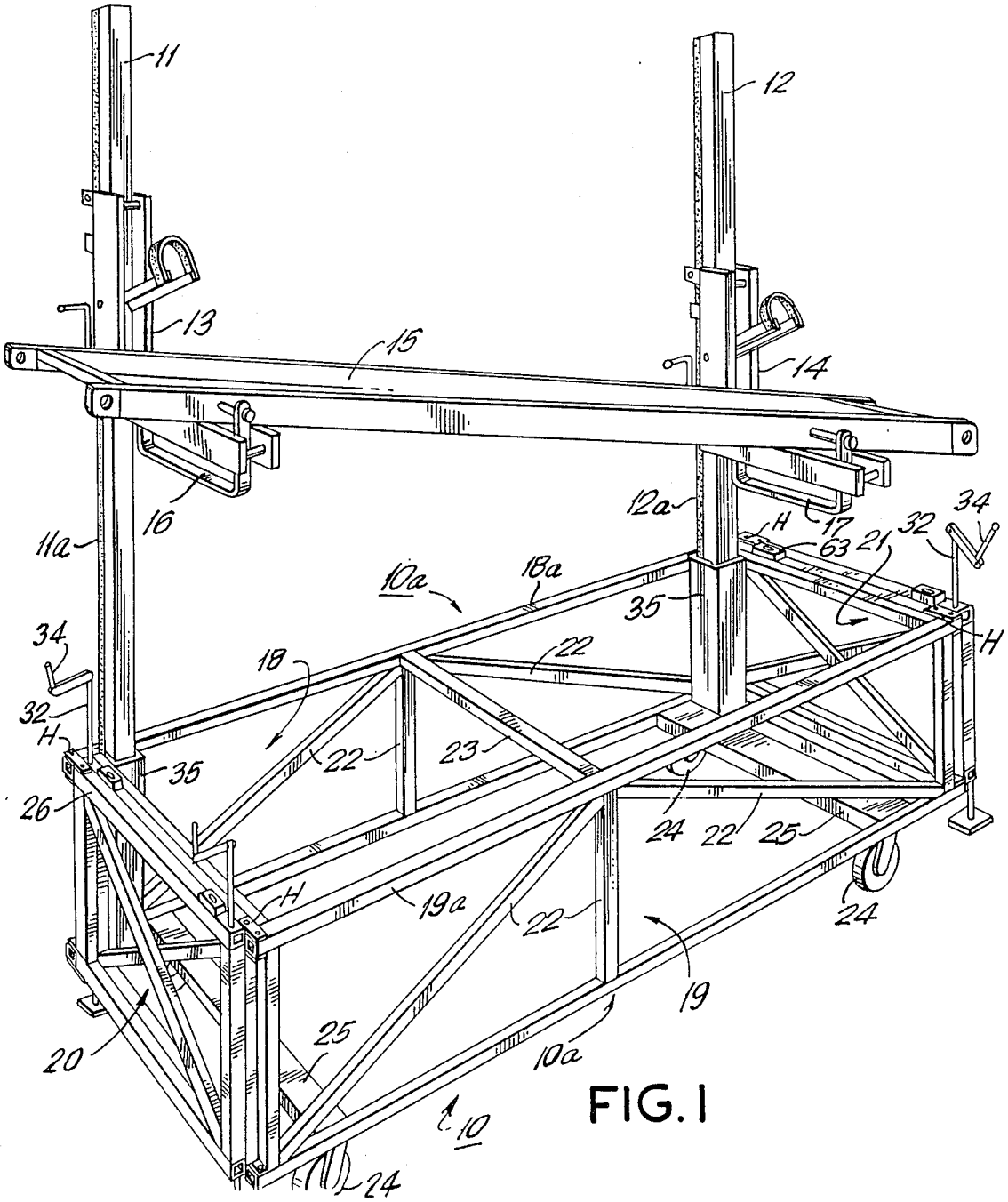
FIG. 1 is a perspective view of a pump jack pole type scaffolding system having a mobile supporting structure in accordance with the invention. In this figure the supporting structure comprises a framework of metal rods and the stabilizing wings of this supporting structure are shown in a folded closed position.
Figure 2A:
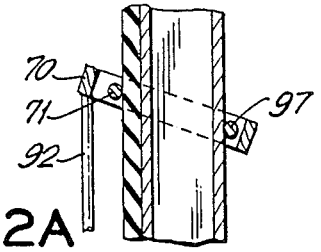
FIG. 2A is a partial sectional view of a shackle gripping a pole and FIG. 2B is a view seen from arrow B of FIG. 2, on an enlarged scale.
Figure 2:
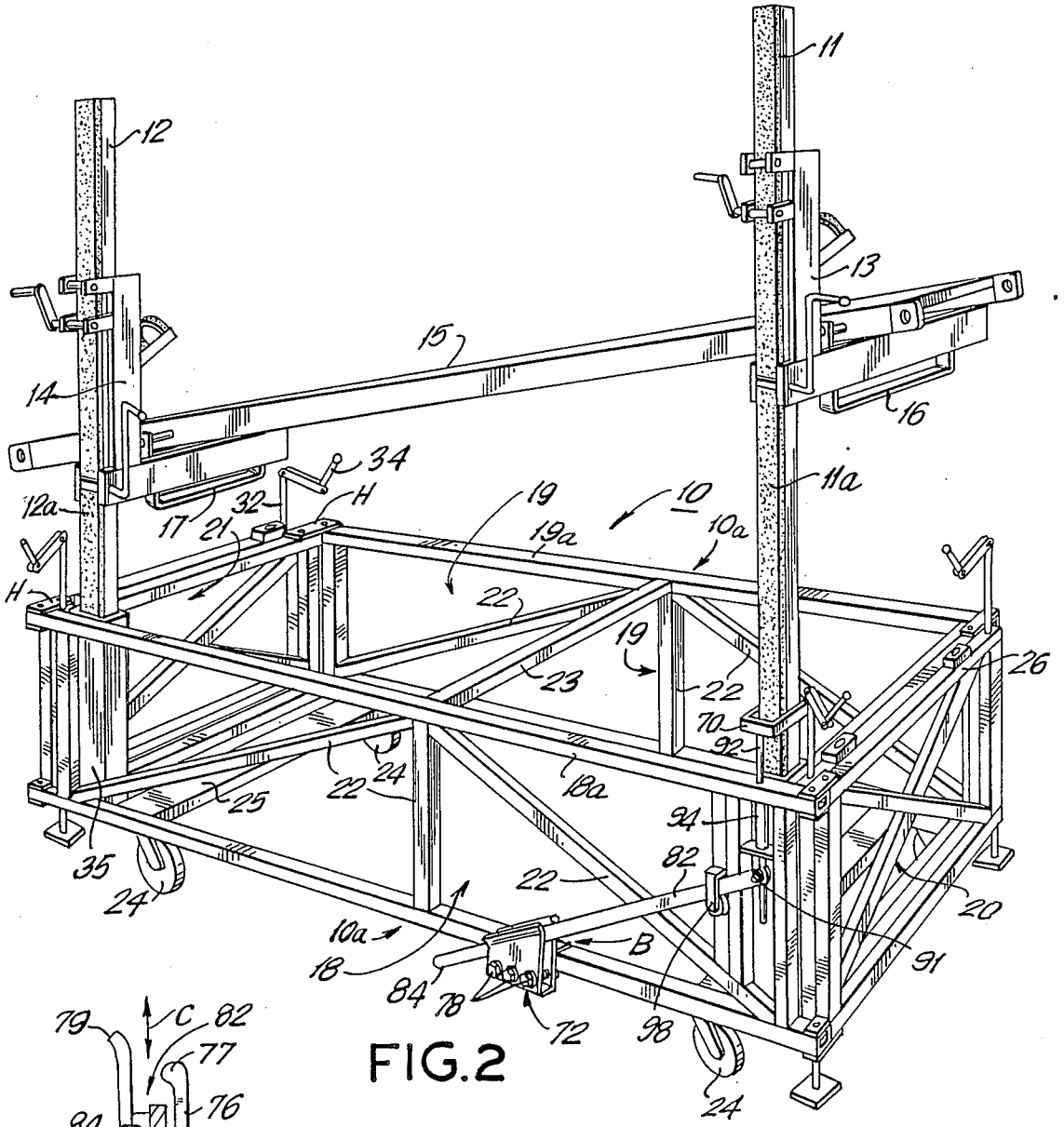

Referring to FIGS. 1 and 2 there is shown a mobile scaffolding system embodying the invention including a mobile scaffold support 10, a pair of pump jack poles 11, 12 upstanding from support 10, a pair of pump jacks 13, 14 respectively riding on poles 11, 12 and the scaffold staging 15 carried on the support arms 16, 17 of pump jacks 13, 14. A further safety rail (not shown) may be connected between the two pump jacks 13, 14 when the desired elevation is reached.

The mobile scaffold support 10 is a rectangular four-sided structure 10*a* shown in FIGS. 1–4 as being formed by the open framework sides 18, 19, 20, 21 with the two opposing sides 18, 19 being considerably longer than the remaining opposing sides 20, 21. The open framework of these sides is constructed from metal rods fastened together, such as by welding, to form the four-sided rectangular structure 10*a*. Preferably, as shown, these rods may be hollow aluminum rods of square cross section. Such aluminum rods are lightweight but yet have great strength.

More specifically, each framework side 18, 19, 20, 21 has a rectangular outline with the longer sides 18, 19 containing three additional bracing rods 22. One further bracing rod 23 spans the top central region or these two longer sides.

The structure is made mobile by four caster type wheels 24 secured to and depending from two c-shaped struts 25 extending across the bottom of the structure and respectively connected to its bottom and bracing rods adjacent the four corners. These struts 25 not only firmly retain the wheels 24 but also help brace and strengthen the entire mobile scaffold support 10.

Figure 3:
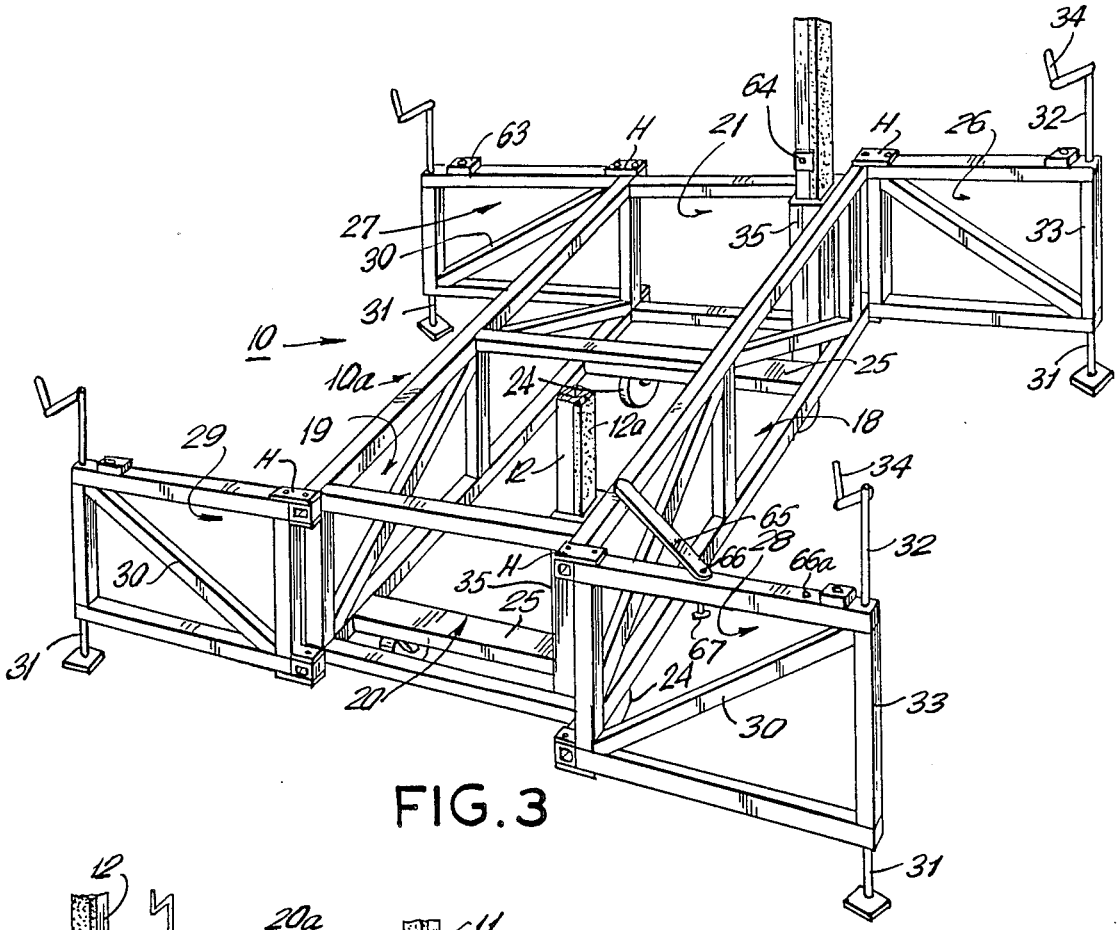
FIG. 3 is a perspective view of the mobile pump jack pole supporting structure with its stabilizing wings in a swung open position.
Figure 4:
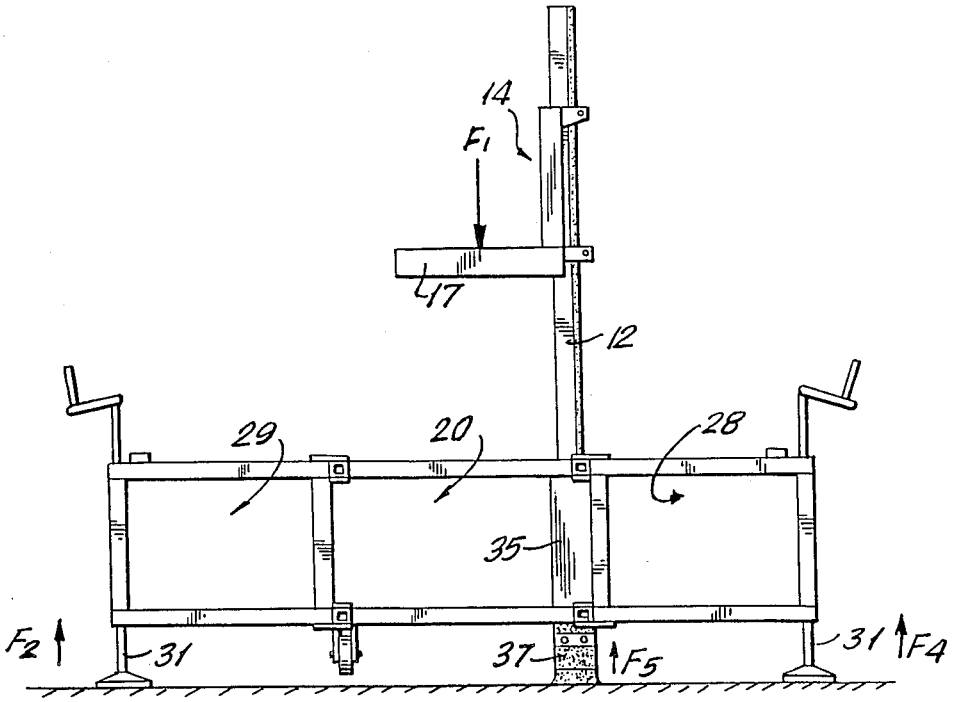
FIG. 4 is a diagrammatic side view of the scaffolding of FIG. 1 showing an extensible boot of the supporting structure in its extended condition against a supporting surface under the force of a weighted down scaffold.

As best seen in FIGS. 3 and 4, the mobile scaffold support 10 also has four outrigger type wings 26, 27, 28, 29 pivoted on hinges H secured to the top and bottom rods at the four corners of the structure. These wings 26–29 are each similarly constructed as an open framework of metal rods with a rectangular outline corresponding to the outline of the two shorter sides 20, 21 of the four-sided structure 10*a*, but also contain an additional bracing rod 30. These wings 26–29 have means extensible beyond wheels 24 for stabilizing and restraining motion of mobile support 10 in the form of screw-down legs 31 located at the distal ends of the wings. Each screw-down leg preferably comprises a long threaded shank 32 which passes through and is threaded within the distal vertical metal rod 33 of each wing and has a crank at its upper end for rotating the leg to screw it down against an ultimate supporting surface. The length of shank 32 is adjusted to limit the extension of legs 31 a short distance beyond wheels 24.

Each pair 26, 27 and 28, 29 of these wings is normally maintained in interleaved folded down condition against an adjacent one of the two shorter sides of structure 10*a*, but each wing may be swung open to different radial positions around the respective corner on which it is pivoted when the mobile support 10 is in a stationary location. In FIGS. 3 and 4 these wings are shown in positions perpendicular to the longer sides 18, 19 of the structure 10*a*.

Wings 26–29 also carry levelling devices 63, on the top surfaces of the wings near their distal ends. These levelling devices 63 are preferably of the "bird's eye" type capable of taking sighting of predetermined locations on the apparatus. By adjusting the four screw-down legs while cross sightings are taken by the four levelling devices, the entire scaffold support can be made level despite variations in level or grade of the supporting surface. In addition to or alternatively with levelling devices 63, a levelling device 64 can be provided on the surface of the vertical pole 11, in order to determine and level the scaffold support position in the vertical direction.

In order to support and retain the pump jack poles 11, 12 on the mobile support 10, a pair of pole receivers 35 respectively abut and are secured to the two inside corners of the supporting structure 10*a* adjacent one longer side 18. It will be appreciated that for this purpose the length of sides 18, 19 may be made equal to the distance generally desired between the two pump jack poles 11, 12 for example, 7 feet. The length of the remaining two shorter sides 20, 21 is preferably made slightly less than 30 inches so that the structure 10*a* can pass through doorways of 30 inches or more.

Figure 4A:
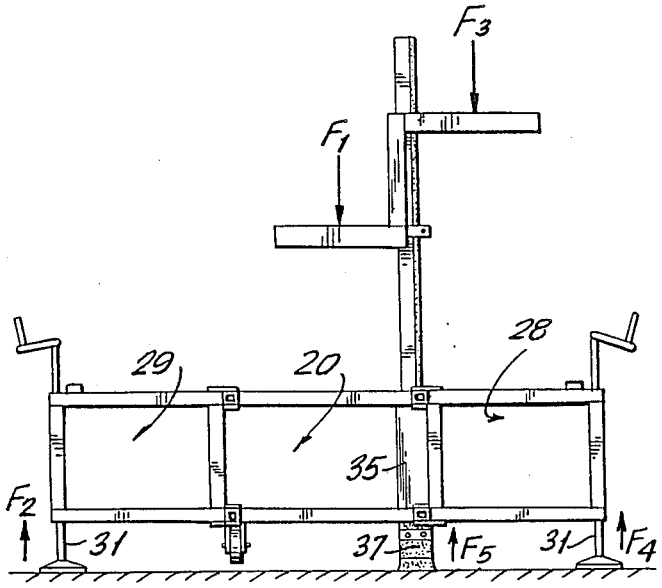
FIGS. 4*a* and 4*b* are diagrammatic illustrations of the scaffolding a FIG. 4 in different conditions of use.
Figure 4B:
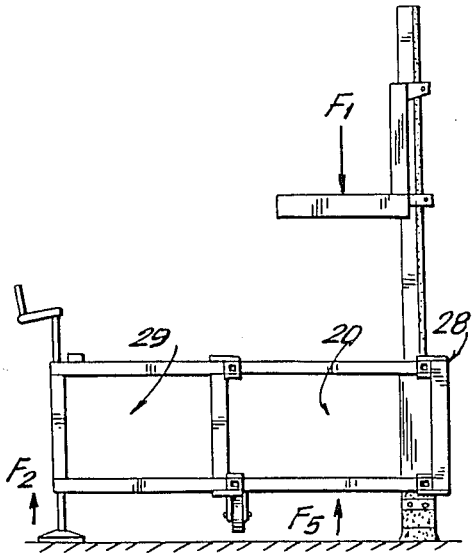

The pump jack poles 11, 12 are shown as being of the type having a rubberized surface 11*a*, 12*a* on only one side of the pole, as described in U.S. Pat. No. 4,382,488. The poles 11, 12 are inserted into the pole receivers 35 with their rubberized sides facing toward the longer side 18 and away from the remainder of the support 10. The pump jacks 13, 14 grip these rubberized surfaces as they ride up and down poles 11, 12 with their support arms 16, 17 and the staging 15 carried by these support arms overhanging the mobile support 10 in cantilever fashion. As shown in FIGS. 4, 4*a* and 4*b*, the forces exerted by support 10 against an ultimate supporting surface at points in the direction of side 19 can thus serve to counterbalance the weight of, and weights applied to, the scaffold staging, as indicated by the arrows f1 and f2. When the wings 29 pivoted on the corners of side 19 are swung out to a position perpendicular to the side 19, as shown in FIGS. 3 and 4, and the legs of these wings are screwed down, great stability is lent to the entire scaffold, and it can be raised to considerable heights without toppling.

Figure 5:
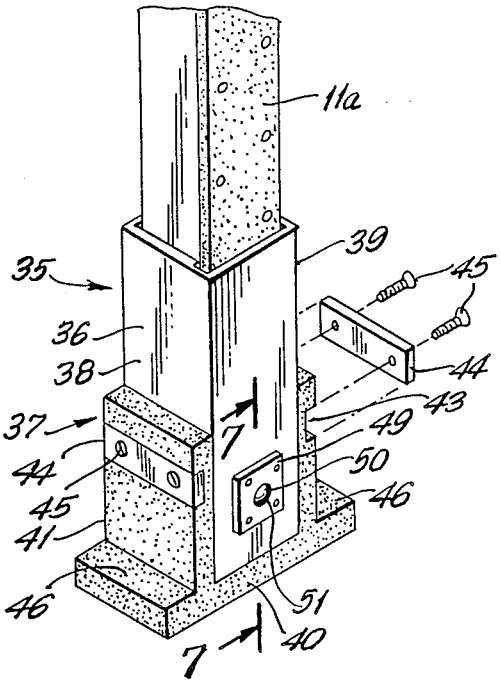
FIG. 5 is a perspective view of a pole receiver of the supporting structure showing the detailed construction of the extensible boot.
Figure 6:
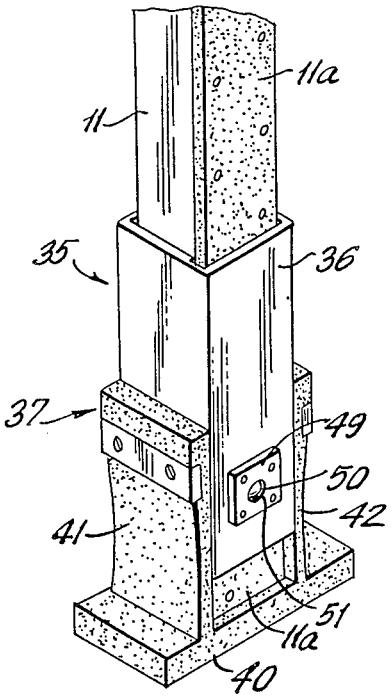
FIG. 6 is a perspective view of the pump jack pole inserted within its supporting metal sleeve and holding the extensible boot in its extended condition.
Figure 7:
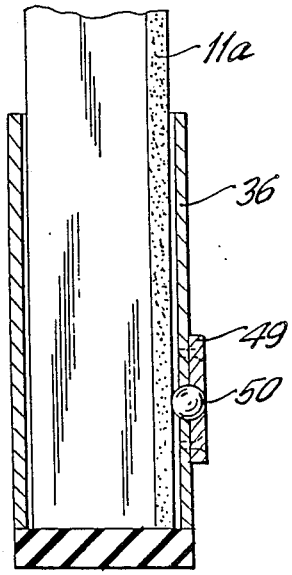
FIG. 7 is a cross sectional view taken along plane 7—7 in FIG. 5 of the bottom portion of this metal sleeve with an inserted pump jack pole and a bearing attached to the sleeve for insuring the slideability of the pole within the sleeve.

As best shown in FIGS. 5–7, the pole receivers are each made up of a hollow metal, preferably aluminum, sleeve 36 of rectangular cross-section and an extensible boot 37 which is attached to opposite sides 38, 39 of sleeve 36 and covers the bottom opening of sleeve 36. Boot 37 is generally u-shaped with a flat base plate 40 covering the sleeve opening and two upstanding legs 41, 42. The legs 41, 42 have notched channels 43 across their upper portions which contain metal fastening bars 44 through which bolts 45 are passed and screwed into sleeve 36. Base plate 40 preferably has flange portions 46 extending beyond legs 41, 42. Extensible boot is preferably made of rubber or a rubber-like material, such as an ethylene propylene polymer, having greater strength and durability but yet good elasticity.

The inner dimensions of each sleeve 36 are made slightly larger than the outer dimensions of the poles 11, 12 so that the poles slide freely within the sleeves but yet are laterally supported thereby. The extensible boots 37 provide means for further stabilizing and restraining motion of the scaffolding when they are extended by poles 11, 12 beyond wheels 24 and against an ultimate supporting surface. The scaffolding system of the invention with the boots 37 extended against an ultimate supporting surface is illustrated in FIG. 4 and the extension of a boot 37 under the force of a pole 11, 12 is illustrated in FIG. 6. It will be appreciated that when these boots 37 are extended by poles 11, 12 against this ultimate supporting surface, this surface carries the weight of the scaffold, as indicated by the arrow f5. The lateral forces and strains exerted on the supporting structure 10*a* are considerably lessened and the stability of the entire scaffolding system is greatly increased and its motion restrained.

It will also be appreciated that the outrigger wings may be opened to several different positions to meet different conditions of use. As shown in FIGS. 4 and 4*a*, all four wings 26–29 may be opened to positions perpendicular to the longer sides of the structure 10*a* for use in the center of a room, with the scaffold on only one side of the poles (FIG. 4) or with scaffolding on both sides of the poles (FIG. 4*a*). For this latter use, pump jack poles such as described in U.S. Pat. No. 4,597,471 may be used having supporting arms extending on both sides of the poles and counterbalancing forces f3 and f4 lend stability to the additional scaffold above wings 26, 28.

As also seen in FIG. 3, a pivotable locking arm 65 is provided between the outrigger wing 28 and the elongated framework side 18 of the scaffold support 10 to stabilize the position of wing 28 perpendicular to the side 18 of the scaffold support. Supporting arm 65 is pivotably supported at its one end on the upper wall of wing 28 and has at its opposite end an outwardly projecting pin (not-shown) insertable into a hole formed on the upper wall of the framework side 18. A number of holes to stabilize the wing 28 in different pivoted positions relative to the framework side 18 of support 10 may be provided on the upper wall of the framework side 18. It is, of course, understandable that the supporting arm 65 may be pivotally supported on the side 18 and its pin would be then insertable in a hold 66*a* of the outrigger wing 28. In the exemplified embodiment a pivot axle 66 of the supporting arm 65 is spring-loaded by a spring 67 in the upper wall of the outrigger wing 28 to enable the pin (not-shown) on the opposite end of arm 65 to be inserted in different holes of the framework side 18. The other outrigger wings can also be equipped with the pivotable locking arm similar to that of wing 28.

Depending upon the composition, thickness and elasticity of the material, the boots 37, may for example, be constructed to carry the weight of poles 11, 12, pump jacks 16, 17 and the staging 15 without extension, but to become extended when the weight of a person on the staging is added thereto.

As shown in FIGS. 5 and 6, the pump jack poles 11, 12 are oriented within the metal sleeves 36 such that the rubberized surface 11*a* slides against the inner surface of one of the sides 47 of sleeve 36 between the two sides 38, 39 to which the boot legs are secured. Notches 48 are provided along the inner corners of the sleeve 36 to accommodate the slightly extended side edges of this rubberized surface 11*a* and to assure this desired orientation of the poles 11, 12 within the sleeves 36. Bearing means are also preferably provided in this side 47 against which a pole 11, 12 slides to prevent the pole and its rubberized surface from tilting against or otherwise becoming stuck against this side. This bearing means is shown as a metal bearing holder 49 attached to side 47 and containing a ball bearing 50 which extends through a hole 51 in the sleeve 36 to roll against the rubberized surface 11*a* of a pole 11, 12.

Figure 8:
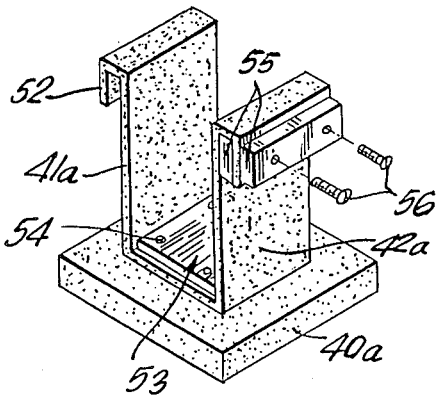
FIG. 8 is a perspective view of an alternative construction of the extensible boot.

While the base 40 and legs 41, 42 of boot 37 may be formed of a single integrally molded extensible material, as shown in FIGS. 5 and 6, it may alternatively be formed of two separate parts, preferably rubber, that are cemented, fastened or otherwise secured to each other. Such an alternative construction is shown in FIG. 8, in which the legs 41*a* and 42*a* may be formed of a U-shaped rubber strip 52 which has a metal plate 53 secured thereto by rivets 54 at the base of the "U". This metal plate 53 separates the two legs and acts as a seat for the bottom end of an inserted pole 11, 12. The rivets 54 may also be used to fasten the U-shaped rubber strip 52 to the base 40*a* of the boot 37*a*. The upraised legs 41*a*, 42*a* of this strip 52 have their upper portions folded over and clamped between two metal retaining bars 55 which are secured to the sides of the sleeves 36 by bolts 56 which extend through the bars 55 and folded over strip ends 57 to be threaded into the metal sleeve 36. This two-part construction permits a wider selection of rubber or rubber-like material for strip 52 and also results in a stronger connection between the boot 37*a* and the sleeve 36.

Figure 9:
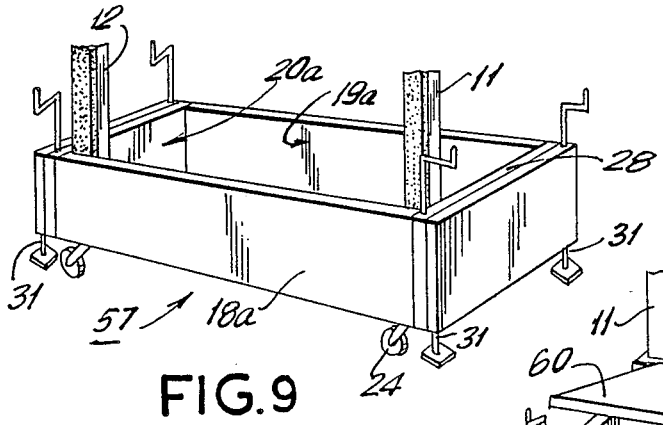
FIG. 9 is another embodiment of the invention in which the mobile supporting structure comprises a box suitable for carrying tools or other equipment.
Figure 10:
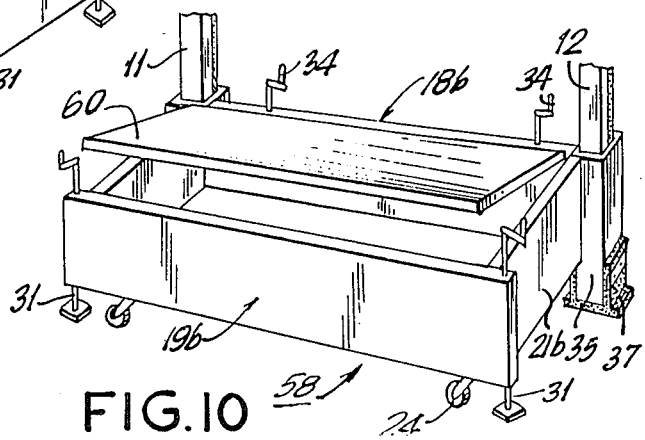
FIG. 10 is a perspective view of an alternative construction of the embodiment of the invention shown in FIG. 9.

While the mobile scaffold support 10 has been shown in FIGS. 1–4 as a lightweight, easily maneuverable open metal framework, it may alternatively at some sacrifice in mobility be a rectangular box having four closed sides, rather than the open framework sides, as well as a bottom floor within which tools and other accessories may be carried and stored. Suitable box constructions are shown in FIGS. 9 and 10. The box 58 shown in FIG. 9 is an open box 58 having closed sides 18*a*, 19*a*, 20*a*, 21*a* and rectangular panels for outrigger wings 26*a*, 27*a*, 28*a*, 29*a*. The pole receivers 36 and other parts of the mobile support 10 remain unchanged.

Alternatively as shown in FIG. 10, a covered box 59 is provided with closed sides 18*b*–21*b* and a bottom floor 60, but the pole receivers are secured along the exterior of the two corners, rather than along the inner corners, at one of the longer sides. The outrigger wings have been eliminated. A single cover is hinged to the top of the side of the box between the pole receivers. Two of the screwdown legs are threaded through this side near to the corners but away from the wheels 24. The remaining two legs are threaded through extensions of the opposite longer side beyond the corners. Since the outrigger wings have been eliminated, it is preferable in this embodiment to make the two shorter sides 20*b*, 21*b* of somewhat greater length than in the embodiments containing outrigger wings. Sides 20*b* and 21*b* may, for example, be four feet long.

It will thus be seen that in accord with the described invention a mobile scaffolding system and mobile scaffold support have been provided which meet the objects of the invention and have great strength, rigidity, stability and safety as well as versatility in application.

In using the invention, for example, in a factory having high ceilings, the mobile support 10 with its wings folded may be wheeled through the doorway into the interior of the factory to a desired stationary location in a central region of the room. The four wings are then pivoted out to positions perpendicular to the longer sides of the structure 10*a* and the four legs 31 are then screwed down until the structure 10*a* is raised a few inches above the wheels 24. The pump jack poles and the pump jacks with the scaffold staging is already mounted on the structure and in place. The entire scaffolding system is then levelled by taking sightings through levelling devices 34 and readjusting the screwdown legs accordingly. A worker or workers may then mount the staging and raise the scaffold to the desired elevation by operating the pump jacks. It will be appreciated that as soon as a worker mounts the staging, the extensible boots of the pole receivers are firmly pressed and seated against the floor of the factory by the force of the poles inserted within the pole receivers.

If it becomes necessary to move the scaffold to a new stationary location, the pump jacks are lowered and the workers must dismount before the scaffold support can again be moved. Since the boots are constructed to carry the weight of scaffold without extension beyond the wheels when no workers are standing thereon, it is then only necessary to raise the screw-down legs, fold in the wings, and move the entire scaffolding to the new location. In this new location, it is only necessary to reset the outrigger wings and relevel the scaffold support. If this new location should be adjacent a wall, the outrigger wings which are pivoted on the corners of the longer side adjacent the wall may be kept in their folded-in condition or may preferably be pivoted to positions parallel with the wall.

Figure 2B:
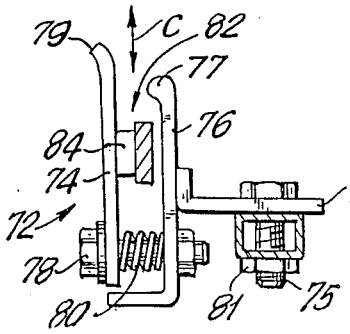

Referring now to FIG. 2 and FIGS. 2A and 2B which show details of the scaffolding system of FIG. 2, it will be seen that a modified system stabilizing arrangement can be provided in the mobile scaffolding system of the present invention. At least one pole 11 is provided with a substantially rectangular shackle 70 which surrounds the pole and supports a square rod 71 which bites into the rubberized surface 11*a* of the pole to grip the pole so as to hold the same in the elevated position and permit the scaffolding system to roll on wheels 24. The scaffolding system stabilizing arrangement further includes an inverted U-shaped holder 72 fastened to one of the framework sides by a angle bracket 73 welded to holder 72 and bolts 75 with nuts 81. Holder 72 includes two substantially vertical plates 74 and 76 spaced from each other and connected to each other by spring-loaded bolts 78. Springs 80 permit a relative movement of the two vertical plates 74 and 76 in the transverse direction. Between vertical plates 74 and 76, is positioned a lever 82 which is provided at one side thereof with a rubberized surface 84 to provide more controllable friction between the lever 82 and the inner sides of the vertical plates 74 and 76. A shorter end 84 of the lever 82 extends outwardly from the holder 72 in one direction whereas the remaining part of lever 82 extends outwardly from holder 72 in the opposite direction. The upper ends of vertical plates 74 and 76 have protrusions 77, 79 so as to facilitate nesting of the lever 82 in the position shown in FIG. 2. Lever 84 is pivotable into and from the space between vertical plates 74 and 76 (as shown by arrow C in FIG. 2B) about a fulcrum 98 which includes a sleeve and a roller. The end of the arm 82 is connected to a pivot 91 to which a rod 92 extending through a tubular member 94 is connected. The upper end of rod 92 abuts against the underside of shackle 70. Shackle 70 has on the inner surface thereof the square rod 71 which bites into the rubberized surface 11*a* of pole 11 to hold the pole in the elevated condition. A roller rod 97 on the backside of the pole is also supported by the shackle 70. Only one holder 72 with lever 82 and rod 92 is shown in FIG. 2 for the sake of clarity. It is, of course, understandable that a second stabilizing arrangement can be provided for the second pole 12.

In order to stabilize the scaffold support after it has been moved on wheels 24 to a desired position an operator presses downwardly on the extended end 84 of lever 82 to insert it into holder 72. The arm 82 pivots about the fulcrum 98 so that the distal end of arm 82 is pivoted upwardly and causes the rod 92 to move upwardly against the underside of shackle 70 which causes the shackle 70 to angulate into the position shown in FIG. 2A. Continued upward movement of rod 92 then pushes upward on the locked shackle 70 which now causes the pole 11 to rise from the ground. The entire apparatus can then be freely moved.

When the apparatus has been properly positioned, the operator then mounts the scaffold staging platform 15.

Once the operator is standing on the staging 15 of the scaffold system his weight is transmitted to the pole and via shackle 70 to the rod 92 which will move downwardly to release the arm 82 from between the two plates 74, 76. This will permit the end 84 to move upwardly and pivot about the fulcrum 98. The rod 92 will be released from the shackle 70 permitting the shackle 70 to relax from biting the pole. The pole will then slide down to the floor. The pole-release mechanism 72 is adjustable by adjusting the tightness of the bolts 78. It can be calibrated so as to be able to release the pole when 100 pounds or more weight is placed on the staging platform. The bottom of the pole can have a rubber plate to secure the pole on to the floor.

Tests made of the open framework embodiment of the invention shown in FIGS. 1–4 have proven that a scaffold supported by pump jacks on the pump jack poles can safely be raised to an elevation of at least 18′ feet above an ultimate supporting surface.

In these tests, the metal rods used for the framework of the supporting structure 10*a* were aluminum rods of square cross-section where the aluminum had a thickness of 0.187 inches, and the outer dimension of the entire unit was 9 feet by 8.5 feet. The metal sleeve 36 of the pole receiver was also aluminum of nearly square cross-section having a thickness of 0.25 inches and outer dimensions of 3.625 inches on two opposing sides and 4.025 inches on the remaining two opposing sides. The extensible boot was made of EPDM rubber with side legs 41, 42 having a thickness of 0.250 inches. This boot became extensible against a supporting surface two inches beyond the wheels when a weight of over 250 pounds was applied to an overhanging scaffold.

While I have described certain preferred embodiments of the invention, many modifications may be made, and it is intended by the appended claims to cover all such modifications as fall within the broad scope of the terms thereof.

I claim:

1. A movable scaffolding system comprising a scaffold support having rolling means depending from the bottom thereof, a pair of pump jack poles, means on said support for supporting said poles in a vertical free-standing manner on said support on which can ride a pair of pump jacks respectively mounted on said poles supporting a scaffold staging extending between the pump jacks, and extensible means secured to said support surface for stabilizing and restraining motion of said scaffolding, said extensible means comprising said means for supporting said poles in a vertical manner and being responsive to a weight applied to the scaffold staging.

2. The scaffolding system of claim 1 wherein said extensible means further comprises at least two screw-down legs spaced from each other and from said pole supporting means.

3. The scaffolding system of claim 1 wherein said extensible means further comprises at least two screw-down legs spaced from each other and from said extensible pole supporting means.

4. The scaffolding system of claim 1 wherein said rolling means comprise four wheels depending from said scaffold support, and said extensible means comprises four screw-down legs spaced from one another and being located to be able to lift said support above an adjacent one of said wheels.

5. The scaffolding system of claim 4 wherein said screw-down legs are also spaced from said extensible pole supporting means.

6. The scaffolding system of claim 2 wherein there are four said screw-down legs spaced from each other and from said pole supporting means and said support comprises levelling means located adjacent and cooperating with said screw-down legs to enable said support to be levelled.

7. The scaffolding system of claim 3 wherein there are four said screw-down legs spaced from each other and from said pole supporting means, and said support comprises levelling means located adjacent and cooperating with said screw down legs to enable said support to be levelled.

8. The scaffolding system of claim 1 wherein the extensible pole supporting means comprises a pair of metal sleeves within which the pair of poles are slideably inserted and a pair of extensible boots, each boot respectively secured to the sides of one of said sleeves and covering the bottom of said sleeve, said poles resting upon said boots within said sleeves.

9. The scaffolding system of claim 8 wherein the scaffold support comprises a rectangular four-sided structure and the metal sleeves of said extensible pole supporting means are respectively secured to two inside corners of said structure adjacent one side of said structure.

10. The scaffolding system of claim 9 wherein the four-sided structure also has four outrigger type wings pivoted at the four corners of the structure, and said extensible means also comprises four screw-down legs respectively located at the distal ends of said four wings.

11. The scaffolding system of claim 9 wherein the pump jacks and the respectively staging are carried by said poles in a manner overhanging said four sided structure.

12. The scaffolding system of claim 2, wherein at least one of said poles comprises levelling means positioned in the vicinity of said support.

13. The scaffolding system of claim 10, wherein at least one outrigger wing is provided with a pivotable supporting arm attachable to a side of the four-sided structure to stabilize said wing in a pivoted position thereof.

14. A movable scaffold support for a pump jack pole type scaffolding system comprising a substantially rectangular four-sided structure having rolling means for enabling the movement of said structure along a supporting surface, means including a pair of pole receivers respectively connected to the two corners of said structure adjacent one side thereof for slidably receiving and vertically supporting the bottom end portions of a pair of pump jack poles, and means connected to said structure and downwardly extensible beyond said rolling means against said supporting surface for stabilizing and restraining movement of said scaffold support, said means for stabilizing and restraining movement of said scaffold support being constructed to support said poles and become extensible against said supporting surface when said poles carry a predetermined weight.

15. The scaffold support of claim 14, wherein the pole receivers are connected to the insides of said two corners and comprise a pair of hollow metal sleeves of substantially rectangular cross-section, and the stabilizing and motion restraining means comprises a pair of extensible boots each secured to the sides of a respective one of said pair of sleeves and covering the bottom thereof.

16. The scaffold support of claim 15 wherein the stabilizing and motion restraining means also comprises at least two screw-down legs connected to said structure in spaced relation from one another and from said pole receivers.

17. The scaffold support of claim 15 wherein said four-sided structure also carries at least two outrigger type wings respectively pivoted at the two corners of the structure that are spaced from said pole receivers, and said stabilizing and motion restraining means also comprises two screw-down legs respectively located adjacent the distal ends of said two wings away from said pivots.

18. The scaffold support of claim 15 wherein said four-sided structure also carries four rectangular outrigger type wings respectively pivoted at the four corners of the structure, and said stabilizing and motion restraining means also comprises four screw-down legs respectively located adjacent the distal ends of said wings away from their pivots.

19. The scaffold support of claim 18 wherein each of said four wings has a levelling means located on the upper surface of said distal end of the wing, said four levelling means cooperating with said four screw-down legs to enable the levelling of said support.

20. The scaffold support of claim 15 wherein the material of said boot comprises rubber.

21. The scaffold support of claim 15 wherein the material of said boot comprises an ethylene propolyene polymer.

22. The scaffold support of claim 15 wherein said predetermined weight is the combined weight of the pump jacks and scaffold staging carried by said poles.

23. The scaffold support of claim 15 wherein said predetermined weight is the combined weight of the pump jacks, scaffold stating, and a person on the staging all carried by said poles.

24. The scaffold support of claim 15 wherein two of the opposing sides of said rectangular four-sided structure are approximately seven feet long and the remaining two opposing sides are less than thirty inches long.

25. The scaffold support of claim 15 wherein each side of said rectangular four-sided structure comprises an open framework of metal rods.

26. The scaffold support of claim 15, wherein said four-sided structure comprises an open box having closed sides and a closed bottom, within which box equipment may be carried.

27. The scaffold equipment of claim 18 wherein each of said four screw-down legs extends through a respective one of said wings and is manually operable from above the wing.

28. The scaffold support of claim 18 wherein two opposing sides of said four-sided structure are longer than the remaining two opposing sides, and said wings can be pivoted to positions perpendicular to said longer sides.

29. The scaffold support of claim 15 wherein each boot comprises legs fastened to opposite sides of a respective one of said sleeves and also comprises a base plate covering the bottom of the sleeve.

30. The scaffold support of claim 15 wherein a pair of metal plates are also carried by said pair of boots and cover the bottoms of said pair of sleeves, and each boot comprises a U-shaped extensible strip with the legs of the "U" secured to opposite sides of a respective one of said sleeves and one of said metal plates is fastened to the base of the "U", the poles received by said pole receivers resting upon said metal plates.

31. The scaffold support of claim 29 wherein said metal sleeves each have ball bearing mean secured to one side thereof between the opposite sides to which said legs are fastened for insuring the slideability of a pump jack pole received within the sleeve.

32. The scaffold support of claim 14 wherein the pole receivers are connected to the outside of said corners and comprise a pair of hollow metal sleeves of rectangular cross-section, and the stability and motion restraining means comprises a pair of extensible boots each secured to the sides of a respective one of said pair of sleeves and covering the bottom thereof, said boots being constructed to support said poles and become extensible against said supporting surface when said poles carry a predetermined weight.

33. The scaffold support of claim 32 wherein said four-sided structure comprises a closable box having closed sides and a cover hinged to the top of one of said sides.

34. A movable scaffolding system comprising a scaffold support having rolling means depending from the bottom thereof, a pair of pump jack poles, means on said support for supporting said poles in a vertical free-standing manner on said support on which can ride a pair of pump jacks respectively mounted on said poles supporting a scaffold staging extending between the pump jacks, and means secured to said support for stabilizing and restraining motion of said scaffold support when said rolling means is not in use, said stabilizing means including at least one pole-releasing means adapted to hold at least one pump jack pole in a vertical free-standing manner and release said at least one pole to permit the same to slide downwardly to rest on a supporting surface for the scaffolding system.

35. The scaffolding system of claim 34, wherein said releasing means includes a lever operated manually to control said at least one pole.

36. The scaffolding system of claim 34, wherein said releasing means comprising means for gripping said at least one pole, said gripping means being responsive to a predetermined weight applied to the scaffold staging to release said at least one pole.

37. The scaffolding system of claim 34, wherein said releasing means further includes gripping means for gripping said at least one pole, said gripping means being actuated by said lever which is operated manually to cause said gripping means to release said at least one pole.

38. The scaffolding system of claim 37, wherein said releasing means further includes a holder attached to said support and comprising two spaced plates receiving therebetween said lever.

39. The scaffolding system of claim 38, wherein said releasing means further includes an elongated rod pivotally connected to said lever and acting on said gripping means.

40. The scaffolding system of claim 39, wherein said gripping means includes a shackle surrounding said at least one pole and engageable therewith, said lever upon actuation pivoting to displace said rod which releases said shackle from said at least one pole.

41. The scaffolding system of claim 36, wherein said predetermined weight is at least 100 lbs.

42. The scaffolding system of claim 39, wherein said two spaced plates are connected to each other by springloaded, fastening means.

43. A movable scaffold support for a pump jack pole type scaffolding system comprising a substantially rectangular four-sided structure having rolling means for enabling the movement of said structure along a supporting surface, said support receiving a pair of pump jack poles, means for gripping said poles in a vertical free-standing manner, and means for releasing said gripping means from said poles to allow said poles to extend downwardly beyond said rolling means for stabilizing and restraining movement of said scaffold support against said supporting surface.

44. The scaffold support of claim 43, wherein said four-sided structure carries at least two outrigger type wings respectively pivoted at two corners of the structure, at least one outrigger wing including a pivotable supporting arm attachable to a side of the four-sided structure to stabilize said at least one outrigger wing in any one of pivoted positions thereof.

45. The scaffold support of claim 44, wherein said supporting arm is spring-loaded on said at least one outrigger wing.

46. The scaffold support of claim 43, wherein said gripping means includes a shackle surrounding one of said poles and having on an internal surface thereof prongs engaging with an external surface of said pole.

* * * * *